United States Patent [19]

Sluys

[11] 4,342,277

[45] Aug. 3, 1982

[54] ANCHORING SYSTEM FOR FLOATING MOORAGE

[75] Inventor: Wesley W. Sluys, Bellingham, Wash.

[73] Assignee: Builders Concrete, Inc., Bellingham, Wash.

[21] Appl. No.: 110,084

[22] Filed: Jan. 7, 1980

[51] Int. Cl.[3] ..... B63B 21/24

[52] U.S. Cl. ..... 114/293; 114/263; 405/219

[58] Field of Search ..... 114/263, 266, 293; 405/26, 27, 219, 212, 63, 64, 66, 68; 9/8 P, 8 R

[56] References Cited

U.S. PATENT DOCUMENTS 310,551 1/1885 Averell ..... 405/26

3,977,344 8/1976 Holford ..... 114/263

FOREIGN PATENT DOCUMENTS 571410 9/1977 U.S.S.R. ..... 11 4/293

*Primary Examiner*—Robert B. Reeves

*Assistant Examiner*—Douglas D. Watts

*Attorney, Agent, or Firm*—Seed, Berry, Vernon & Baynham

[57] ABSTRACT

A system for anchoring a large number of interconnected mooring floats in either deep or shallow bodies of water. The system includes a grid of post-tensioned cables positioned beneath the floats and a number of anchoring lines extending between the grid and attachment fixtures forming part of the floats. The anchoring lines are symmetrically secured to the floats so that a force exerted by a line in one direction is opposed by an equal force exerted by another line in the opposite direction. Further, the angles of the anchoring lines with respect to the horizontal are maintained relatively small to minimize the downward force on the float exerted by the tension in the lines. A plurality of spaced apart weights are secured to the anchoring lines to maintain the tension of the lines as the floats rise and fall responsive to tidal changes. The attachment fixtures are formed by tubes extending vertically through the floats adjacent their edges receiving a chain connected to an anchoring line. The chain is locked into position by inserting the chain into a notch forming at the upper end of the tube.

17 Claims, 12 Drawing Figures

ANCHORING SYSTEM FOR FLOATING MOORAGE

BACKGROUND OF THE INVENTION

1. Field of the Invention

This invention relates to floating moorages, and more particularly to a system for anchoring a moorage in a body of water which may be relatively deep and which has a level that can vary considerably.

2. Description of the Prior Art

Moorages composed of a large number of interconnected floats are commonly located in relatively shallow bodies of water. These floating moorages are typically rendered laterally immovable by being loosely secured to upstanding piles embedded in the sea floor.

As the population of boaters continuously increases causing more boats to be constructed, additional marinas must be built to accommodate these boats. Natural shallow water locations for these moorages frequently do not exist in various parts of the country, requiring that less suitable alternatives be considered. Furthermore, otherwise acceptable sites are often ruled off-limits for ecological reasons. Frequently, the only alternatives are relatively deep water moorage sites.

Attempts to apply shallow water floating moorage technology utilizing upstanding piles to deep water sites has not met with success. The reason for this is apparent when one examines the effect of transverse forces imposed on an upstanding pile. The ability of a pile to withstand a given rotational moment is a function of the depth of penetration of the pile in the sea floor as well as the characteristics of the sea floor. The moment imparted to the pile is equal to the product of the moment arm and the magnitude of the side load. Clearly, the moment arm of the longer piles required for deep water moorage is significantly greater than the moment arm of the relatively shorter piles which may be used for shallow water moorages. Thus, with acceptable penetration depth and typical sea floor conditions, the moments imparted to relatively long piles by typical side loads is sometimes sufficient to break the pile or dislodge the pile from the sea floor.

Another problem with floating moorages using upstanding piles is their general unattractiveness, whether or not the moorage is at a deep water or shallow water site. The problem is not significant at high tide since only a small portion of pile is exposed. However, at low tide such moorages present an unattractive forest of piling.

An additional problem with the above described moorages occurs in cold climates where ice develops on the surface of the water. Under certain conditions water adhering to the pile freezes at the EBB cycle causing the pile to adhere to the surface ice. When the tide floods, the surface ice withdraws the pile from the sea floor. Although the withdrawal for each tidal change may be relatively slight, the pile never-the-less becomes dislodged after a sufficient number of cycles.

In addition to the above described problems associated with upstanding pile in general, specific problems exist for various types of piling. Wood piling, for example, is difficult to place, particularly in deep water because the buoyant force of the pile tends to force it into a horizontal position. While concrete or steel piles do not exhibit this problem, they contribute their own sets of problems. Concrete piling, for example, are difficult to transport and require larger equipment for handling and installation. The use of steel pile is limited by their susceptibility to corrosion from rust and electrolysis.

An apparent solution to the aforementioned problems resulting from the use of piling is to eliminate the piling altogether and fix the position of the interconnective floats by other means. While anchoring the floats may appear to be a straight forward alternative, conventional anchoring techniques do not always work under the conditions which the marina floats encounter. In particular, marinas cover a large area and thus cannot be anchored, like a vessel, merely by dropping an anchor overboard. Further, a marina must be located in a fixed geographical location because of specific property boundaries and the need to interface with utility lines such as electric, water, telephone, access, etc. Consequently, drifting of the floats must be kept to a minimum. All of the above problems are greatly increased when the floats are to be anchored in deep water or in bodies of water having a widely fluctuating level.

SUMMARY OF THE INVENTION

It is an object of the invention to provide a system for fixing the position of a plurality of interconnected mooring floats in relatively deep water having a widely varying depth.

It is another object of the invention to provide a system for fixing the position of a plurality of interconnected floats which does not use upstanding piles embedded in the sea floor.

It is still another object of the invention to provide a system of the character described which can accomodate a variety of moorage sizes and sea floor profiles and conditions.

It is a further object of the invention to provide an anchoring system for floating moorages which is not damaged by vertical movements of a surface layer of ice.

These and other objects of the invention are provided by positioning a generally horizontal grid of post tensioned cables beneath a plurality of interconnected moorage floats. A plurality of anchor lines extend from the grid to the floats, with the angle of the line with respect to the horizontal being relatively small so that the downward vector exerted by the anchor line is a relatively small percentage of the anchor line tension. The anchor line is thus able to exert a strong horizontal force on the floats without unduly drawing the floats into the water. The lines are symmetrically secured to the floats so that forces exerted on the floats by each line are opposed by substantially equal forces exerted in an opposite direction by another line. Each of the lines carries a number of spaced apart weights which maintain the tension in the line substantially constant as the floats rise and fall responsive to tidal action. Although the tension of the lines does vary to some extent during tidal changes, the floats never-the-less remain in position because of the symmetrical manner in which the lines are secured to the floats. In most installations, the grid runs along the sea floor. However, in deep water installations or installations in which the seal floor is irregular, the grid may be suspended in the water beneath the floats. Accordingly, a plurality of spaced apart buoys are secured to the grid, and a plurality of weights are suspended from the grid preferably beneath each buoy. In order to insure that the anchor lines do not foul the propellers of boats using the moorage facilities, the anchor lines extend either along the axis of the mainwalk floats or along the arcs of the finger floats projecting perpendicularly from the mainwalk floats. The moorage facilities generally abut a body of land having a bank sloping downwardly to the water. The cables forming the grid adjacent the bank are preferably anchored by extending the cables through the bank into a vertically disposed cavity in which the cables are anchored. A vertically disposed tube is preferably embedded in the float adjacent one of its sidewalls. The anchor lines enter the lower end of the tube and are secured to the tube adjacent its upper end. The anchor lines are preferably connected to chains which extend upwardly through a vertically disposed tube embedded in the floats having fastening means at its upper end to which the chain is secured.

DETAIL DESCRIPTION OF THE INVENTION

Figure 1:
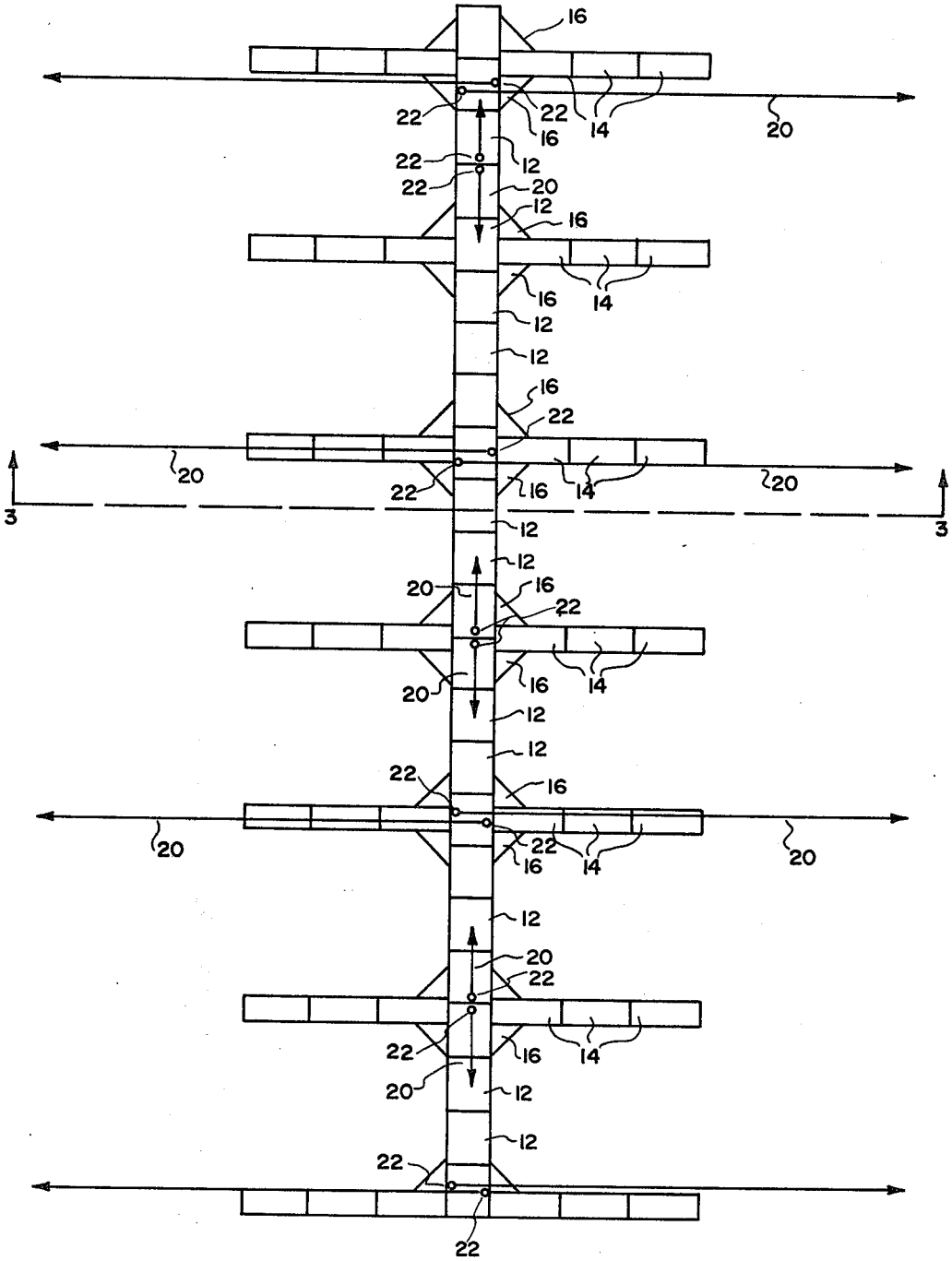
FIG. 1 is a top plan view of one configuration of interconnected floats employing the inventive anchoring system.

One configuration of interconnected mooring floats which may use the inventive anchoring system is illustrated in FIG. 1. The configuration of FIG. 1 utilizes a plurality of substantially conventional mainwalk floats 12 interconnected by elongated wales extending along their outer edges as explained in greater detail hereinafter. A plurality of interconnected finger floats 14 project perpendicularly from the mainwalk floats 12 at spaced apart locations. The finger floats 14 are secured to the mainwalk floats 12 by triangularly shaped gussets 16 of conventional design. In a typical, presently existing installation, the position of the floats 12, 14 would be maintained by piles (not shown) projecting upwardly from the sea floor at the outer ends of the finger floats 14. The outer ends of the finger floats 14 would then be slidably secured to the piles to allow vertical movements of the floats 12, 14 responsive to tidal action.

Figure 2:
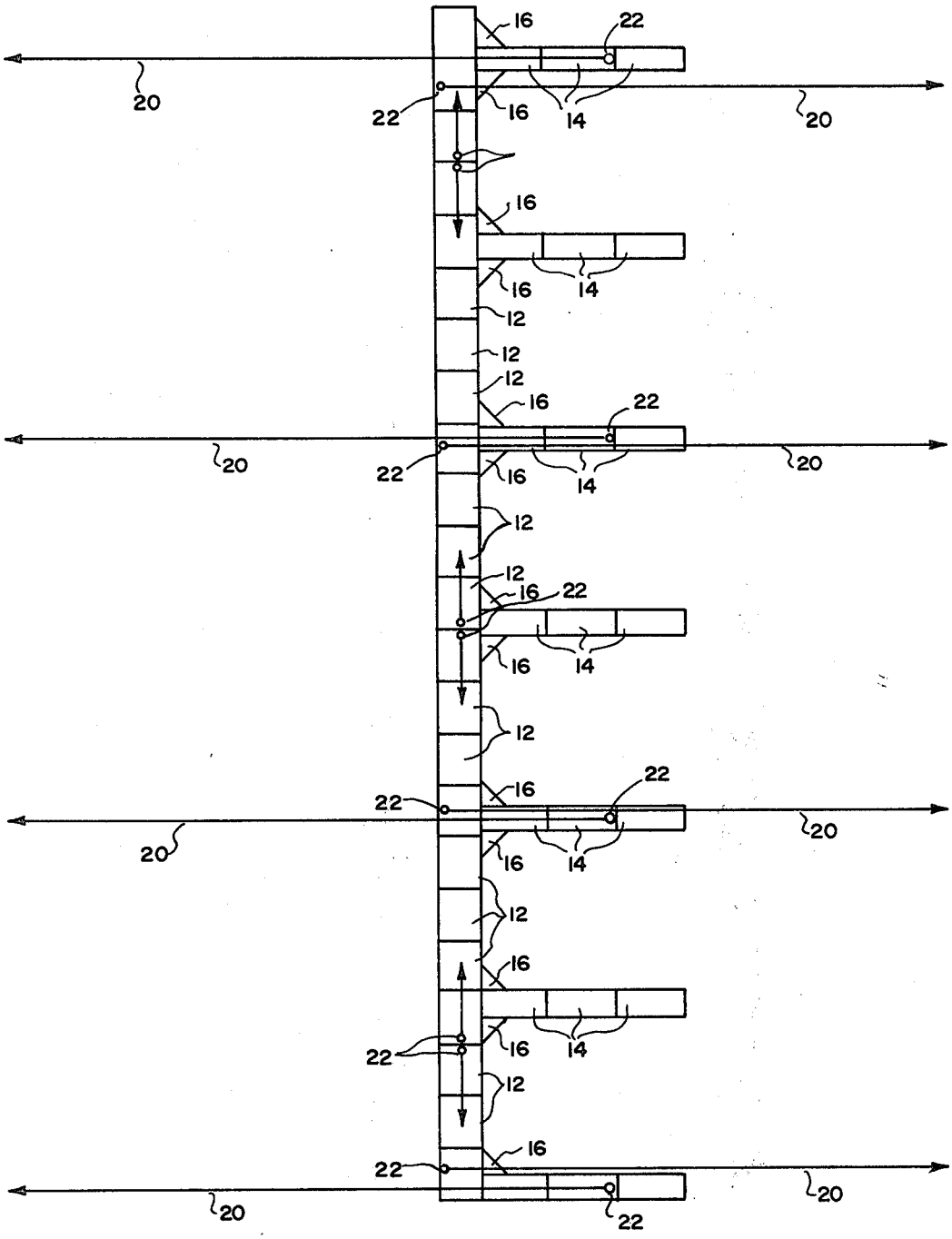
FIG. 2 is a top plan view of another configuration of interconnected floats employing the inventive anchoring system.

In accordance with the present invention, the horizontal position of the floats 12, 14 is maintained by anchor lines 20 extending from fastening fixtures 22 formed in the floats 12, 14. The anchor lines 20 are secured to an underlying grid (not shown) explained in greater detail hereinafter. Although the anchoring system substantially prevents horizontal movements of the floats 12, 14, it allows free vertical movement of the floats 12, 14 responsive to tidal action. It will be noted that forces exerted by each anchor line 20 are opposed by an equal force exerted in an opposite direction by another anchor line 20. Thus, although the tension in the anchor lines 20 may vary, the horizontal component of anchor line tension will always equally oppose each other. It will also be noted that the anchor lines 20 extending perpendicularly from the longitudinal axis of the main walk floats 12 alternate with anchor lines 20 extending along the longitudinal axis of the main walk floats 12. Since the anchor lines 20 extend from the floats 12 at a relatively shallow angle, the lines 20 are just slightly below the surface of the water near the floats 12. Running the anchor lines 20 either along the longitudinal axis of the floats 12 or perpendicularly to the longitudinal axis of the mainwalk floats 12 beneath the finger floats 14 shelters the lines 20 so that they cannot inadvertently foul the propellers of boats using the moorage facilities.

Where the finger floats 14 project from only one side of the mainwalk floats 12, as illustrated in FIG. 2, the above described arrangement of anchoring lines 20 cannot be used since there are no finger floats on one side of the mainwalk floats 12 to shelter the anchoring lines 20 extending from that side of the mainwalk floats 20. Consequently, a fastening fixture 22 is formed in the middle of finger float 14 on some rows so that the anchor line 20 extending to the left in FIG. 2 is well beneath the surface of the water before it clears the left hand edge of the mainwalk floats 12. Consequently, vessels sailing along the left side of the mainwalk floats 12 cannot strike the leftwardly extending anchoring lines 20.

Figure 3:
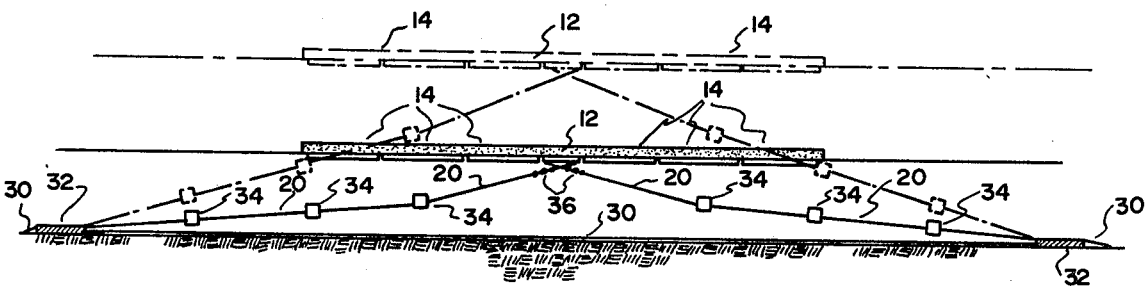
FIG. 3 is a cross-sectional view taken along the line 3—3 of FIG. 1.

The anchor lines 20 extend from the floats 12 at a relatively shallow angle as illustrated in FIG. 3. The ends of the anchoring lines 20 are secured to a post-tensioned cable 30 forming a grid as explained in greater detail hereinafter. An anchor or weight 32 may also be used to secure the ends of the anchoring lines 30 to the sea floor.

A plurality of weights 34 are carried by the anchoring lines 20 to maintain the tension in the lines 20 as the floats 12, 14 rise and fall responsive to tidal action. As illustrated in phantom FIG. 3, the angle of the anchoring line 20 remains relatively shallow as the floats 12', 14' rise to their high water positions, also the horizontal force exerted by one anchoring line 20 exactly opposes the horizontal force exerted by the anchoring line 20 extending in the opposite direction so that the positions of the floats 12, 14 remains constant. The end of the anchoring line 20 adjacent the float 12 is preferrably a length of conventional chain 36 to facilitate securing the line 20 to the float 12 as explained in greater detail hereinafter. The line 20 is preferably composed of a somewhat resilient, but strong material such as nylon to absorb shock imparted to the floats 12, 14.

Figure 4:
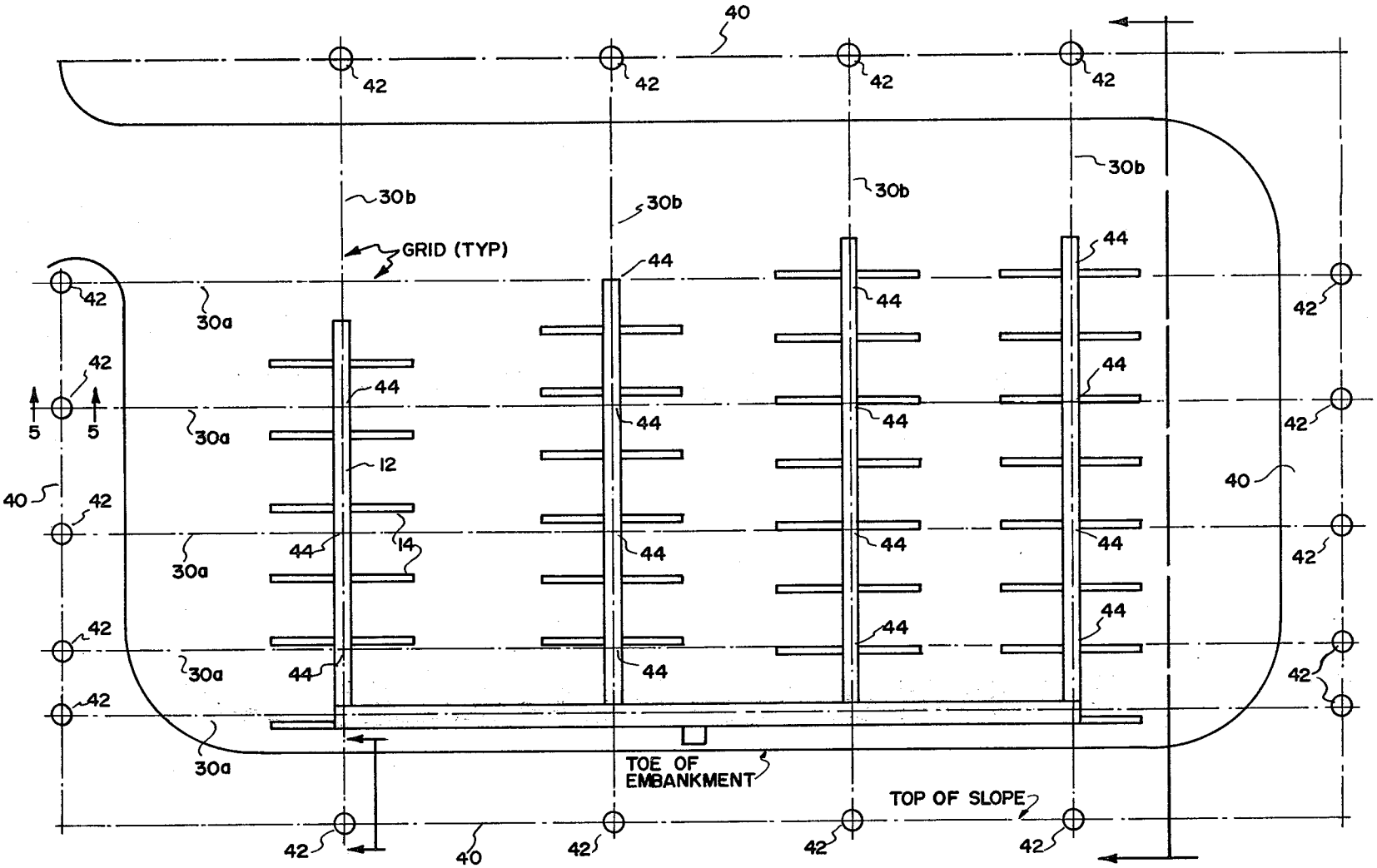
FIG. 4 is a top plan view of a complete moorage facility illustrating the manner in which the cables at the periphery of the grid are terminated.

A complete layout for a floating moorage facility employing the inventive anchoring system is illustrated in FIG. 4. The marina is located within a protective body of water formed by a body of land having banks 40. The ends of the cables 30 forming the grid are secured by an anchoring means 42 as explained in greater detail hereinafter. The cables 30*a* running in parallel in a first direction are secured to cables 30*b* extending perpendicularly thereto at 44 to further rigidify the grid. Where the moorage facility is not surrounded by banks of land, other anchoring devices besides 42 as illustrated in FIG. 4 can be used such as relatively heavy weights or conventional ships anchors.

Figure 5:
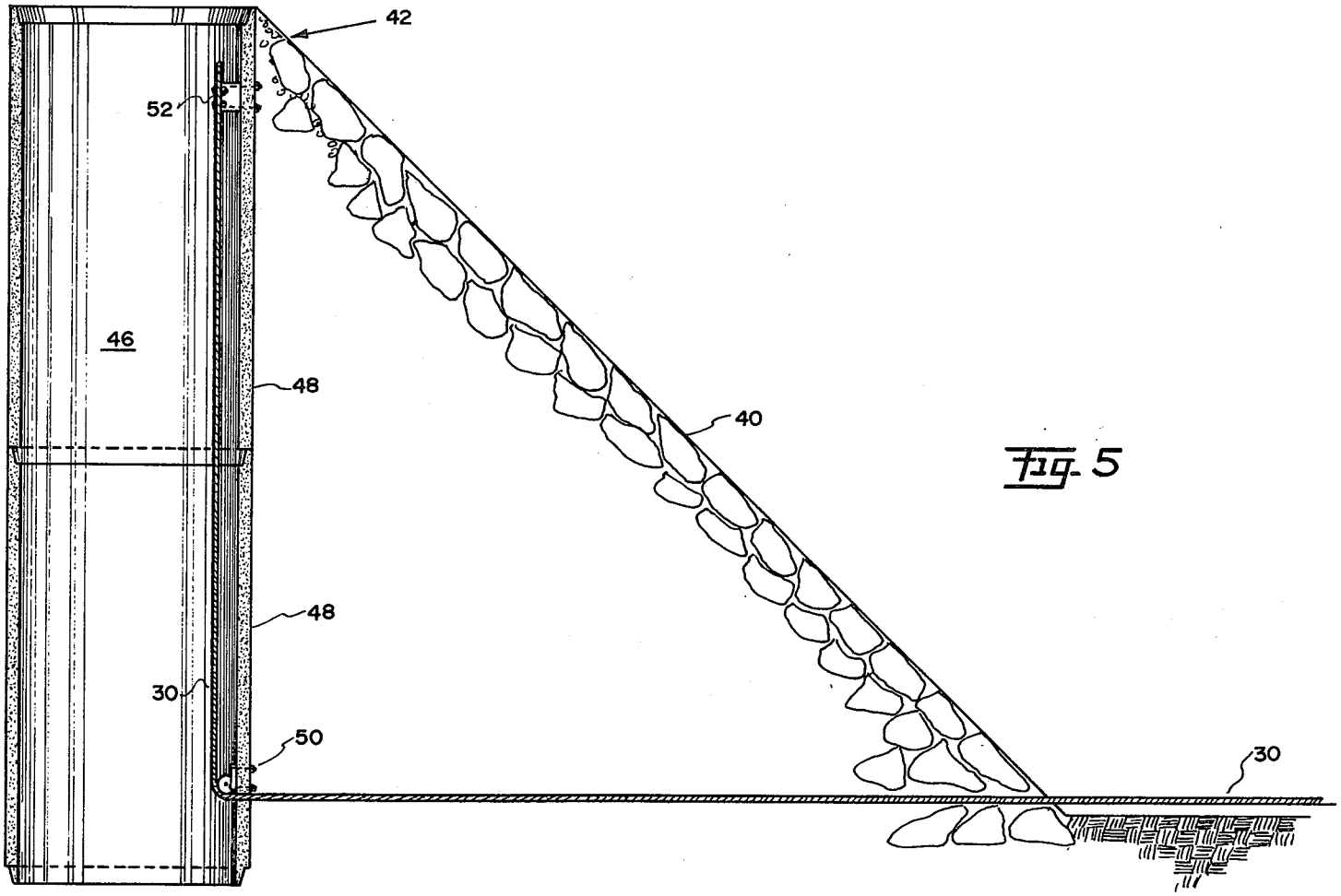
FIG. 5 is a cross-sectional view taken along the line 5—5 of FIG. 4 illustrating the manner in which the cables forming the grid may be terminated where the grid is positioned against a bank sloping into a body of water.
Figure 6:
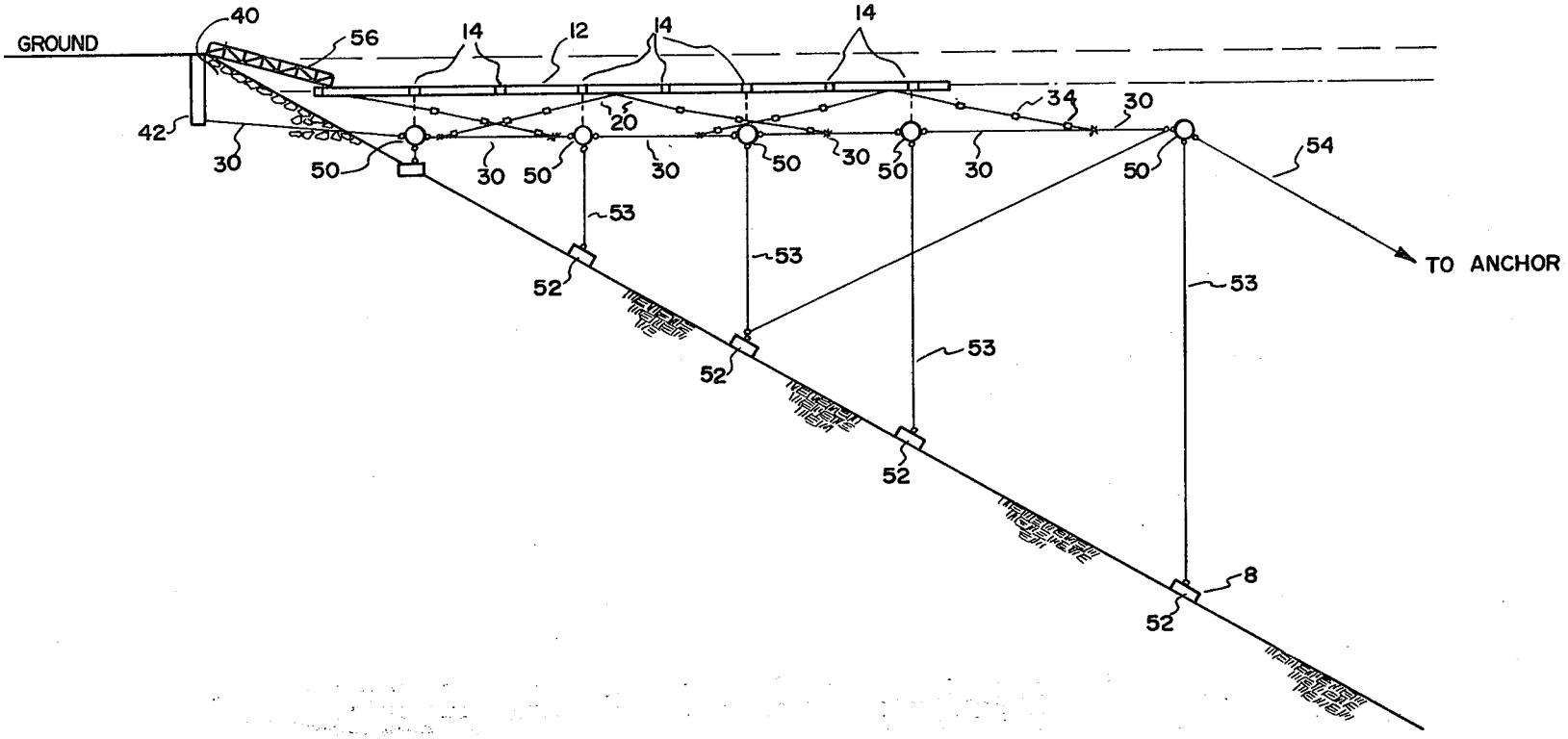
FIG. 6 is a cross-sectional view illustrating the inventive anchoring system adapted for deep water use.

The details of the anchoring device 42 are illustrated in FIG. 5. The cable 30 forming the grid extends along the sea floor and into the earth forming the bank 40. A vertically disposed cavity 46 which may be formed by conventional concrete utility conduits 48 is positioned in the bank. The cable enters an opening toward the bottom of the cavity 46, curves around a brace 50 and is secured to the inner walls of the conduit 48 by fastening means 52 after the cable 30 has been tensioned to a predetermined value. The fastening device 42 thus allows the tension of the cable 30 to be adjusted from outside the water, and it then securely maintains the tension of the cable 30.

The above described embodiments may be used when the moorage facility is located in relatively shallow water having a relatively smooth bottom. However, it is not possible to run the grid along the sea floor, where the sea floor is highly irregular. Also, running the grid along the sea floor in relatively deep water would make it highly impractical for the anchoring lines 20 to extend from the floats 12, 14 at a relatively shallow angle since the area covered by the grid would be unacceptably large. The anchoring system can, however, be used in deep moorages by suspending the cables 30 forming the grid beneath the floats 12, 14 but well above the sea floor. Accordingly, buoys 50 preferably filled with a buoyant foam are secured to the grid cables 30 at spaced apart locations. Weights 52 are suspended from the cables 53, preferably directed from and beneath the buoys 50. The weight 52 are sufficiently heavy so that their downward force is greater than the upward force produced by the buoys 50 so that the vertical position of the grid cables 30 remains fixed a predetermined distance above the sea floor. The ends of the cables 30 adjacent the bank 40 are anchored by the securing means 42 illustrated in FIG. 5. The other ends of the cables 30 are tensioned by a conventional anchor (not shown) secured to line 54. A ramp 56 provides access to the floats 12 as the floats 12 rise and fall in response to tidal action. The cables 30 forming the grid, by remaining in fixed vertical and horizontal positions, accurately simulates the conditions of the cables 30 forming the grid of the shallow water embodiment of FIG. 3. Irregular sea floors or deep water conditions can be easily accommodated merely by varying the length of the lines 53 secured to the weights 52.

Figure 7:
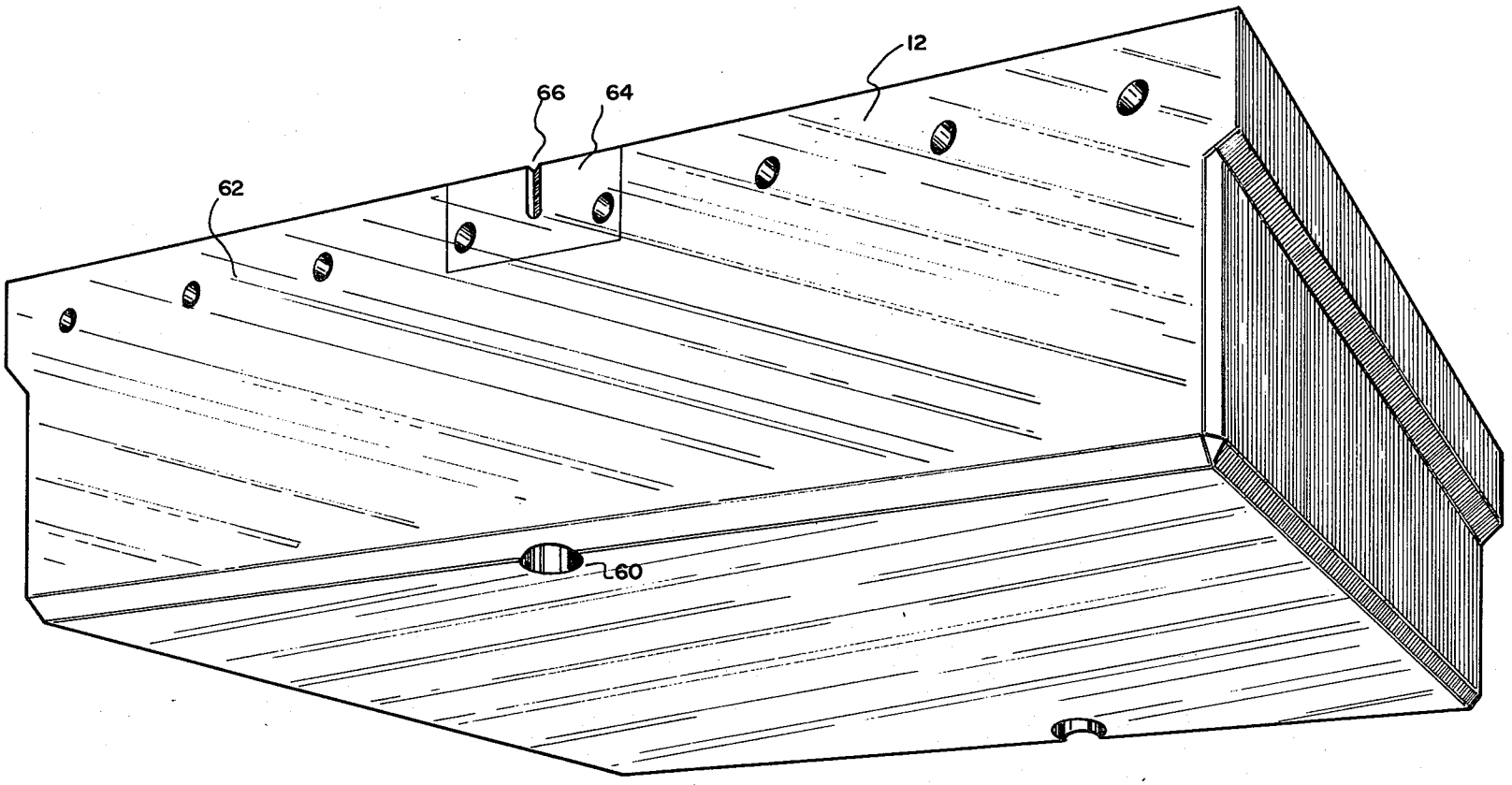
FIG. 7 is an isometric view illustrating one embodiment of a moorage float in which anchoring lines may be secured to the transverse sidewalls of the float.
Figure 8:
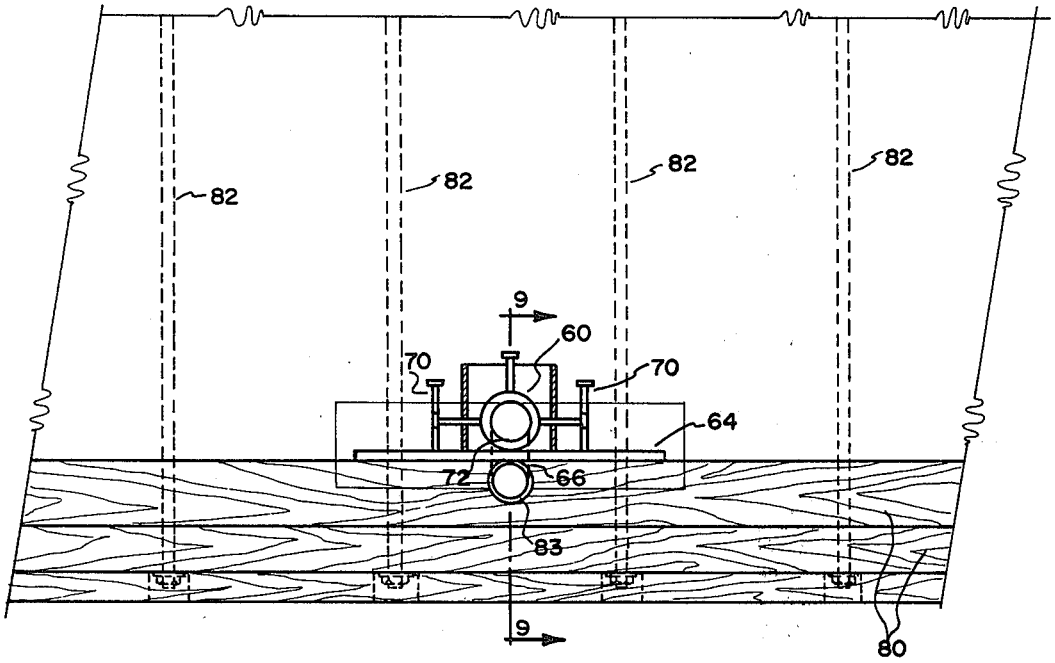
FIG. 8 is a top plan view illustrating in greater detail the fastening means for securing an anchor line to the float of FIG. 7.
Figure 9:
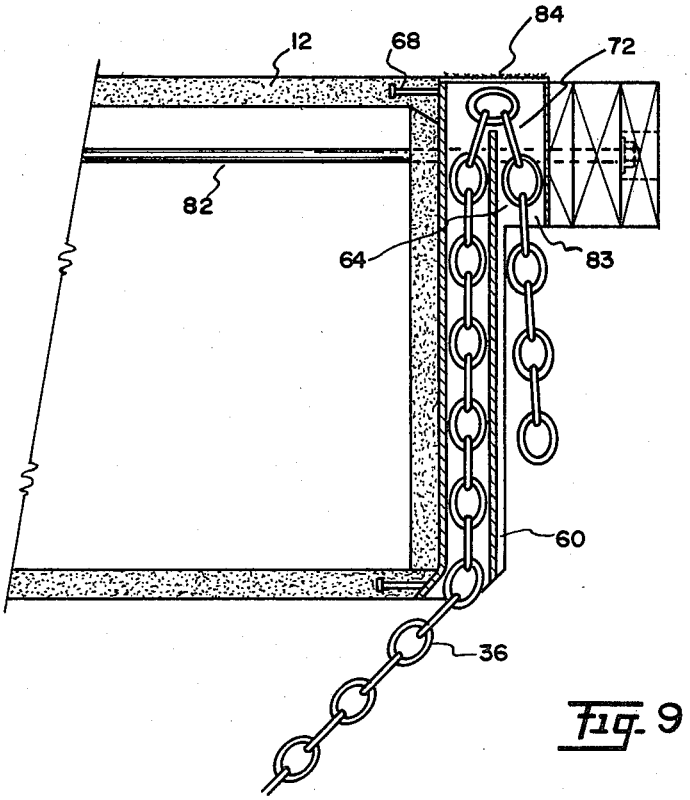
FIG. 9 is a cross-sectional view taken along the line 9—9 of FIG. 8.

Although the anchoring lines 20 can be secured to the floats 12, 14 utilizing a variety of techniques, the floats 12, 14 are preferably adapted to interface with the lines 12. Accordingly, as illustrated in FIG. 7, a vertically disposed tube 60 is embedded in a mainwalk float 12 adjacent its longitudinal side wall 62. As explained in greater detail hereinafter, the tube 60 extends upwardly and is secured to the plate 64 having a notch 66 formed therein. The chain 36 (FIG. 3) is inserted into the lower end of the tube 60, and one of its links is inserted through the notch 66 to secure the chain 36 to the float 12. As illustrated in greater detail in FIGS. 8 and 9, a plurality of anchor members 68 projecting from the tubes 60 are embedded in the concrete forming the float 12. Similarly, anchor members 70 (FIG. 8) project from the inside surface of the plate 64 and are embedded in the concrete forming the float 12. A notch 72 (FIG. 8) is formed in the tube 60 adjacent the notch 66 in the plates 64. The width of the notch 72 is slightly larger than the thickness of a link of chain 36, but it is thinner than the width of the link. Consequently, when the link is inserted in the slot 72, as illustrated in FIG. 9, the notch 72 abutting the tube 60 prevents movement of the chain 36.

As mentioned above, the mainwalk floats 12 and finger floats 14 are interconnected by elongated wales 80, generally formed of wood. The wales 80 are secured to each other and to the mainwalk float by tie rods 82 extending transversely through the mainwalk floats 12. After the wales 80 have been installed on the float 12, a vertical through bore 83 is formed in the inside wale 80 adjacent the tube 60 to allow the excess links of chain to extend downwardly through the wale. The upper end of the tube 60 may then be covered with a rectangular plate 84.

Figure 10:
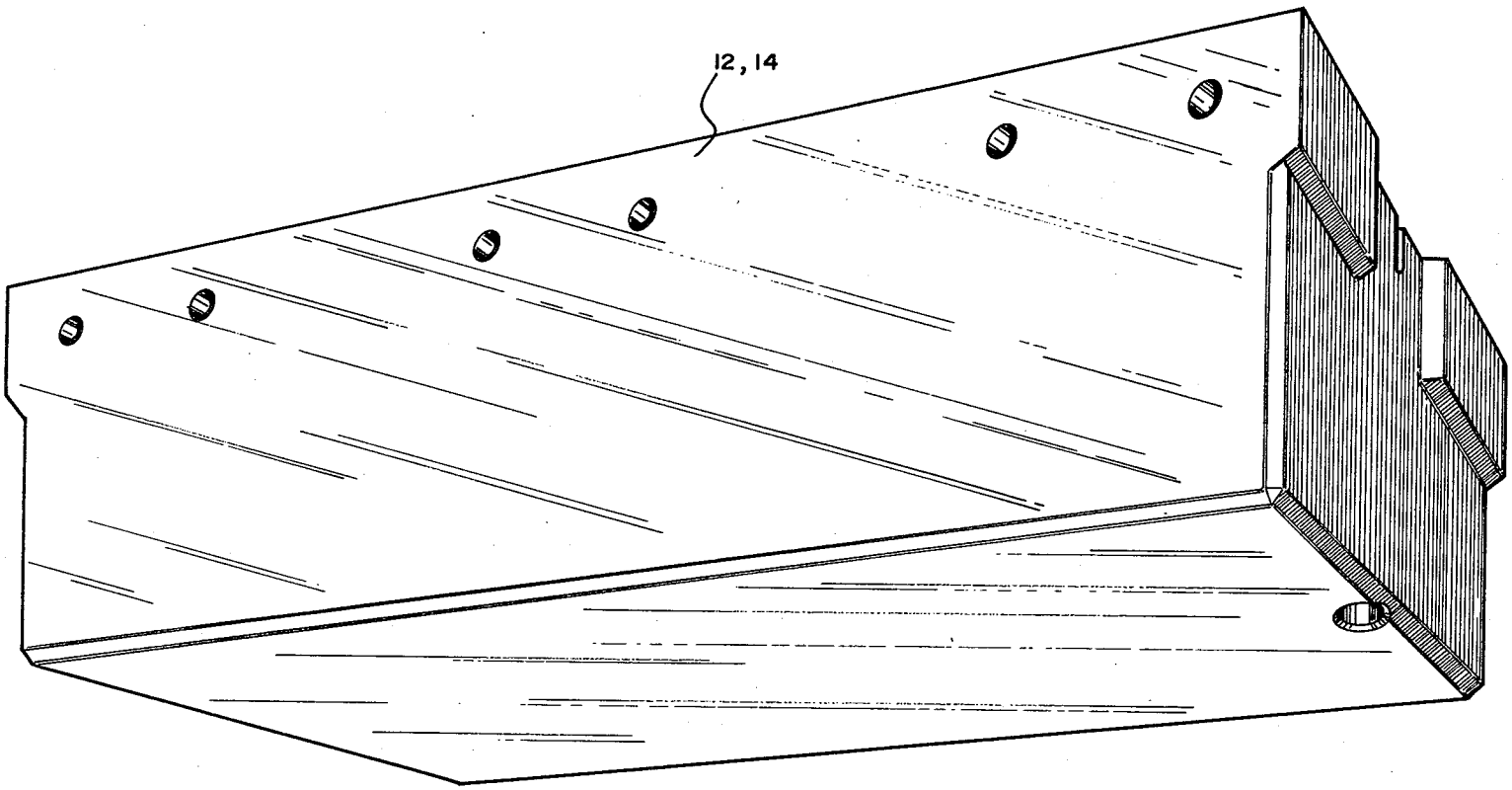
FIG. 10 is an isometric view of another embodiment of a mooring float in which an anchor line may be secured to the transverse endwall of the float.
Figure 11:
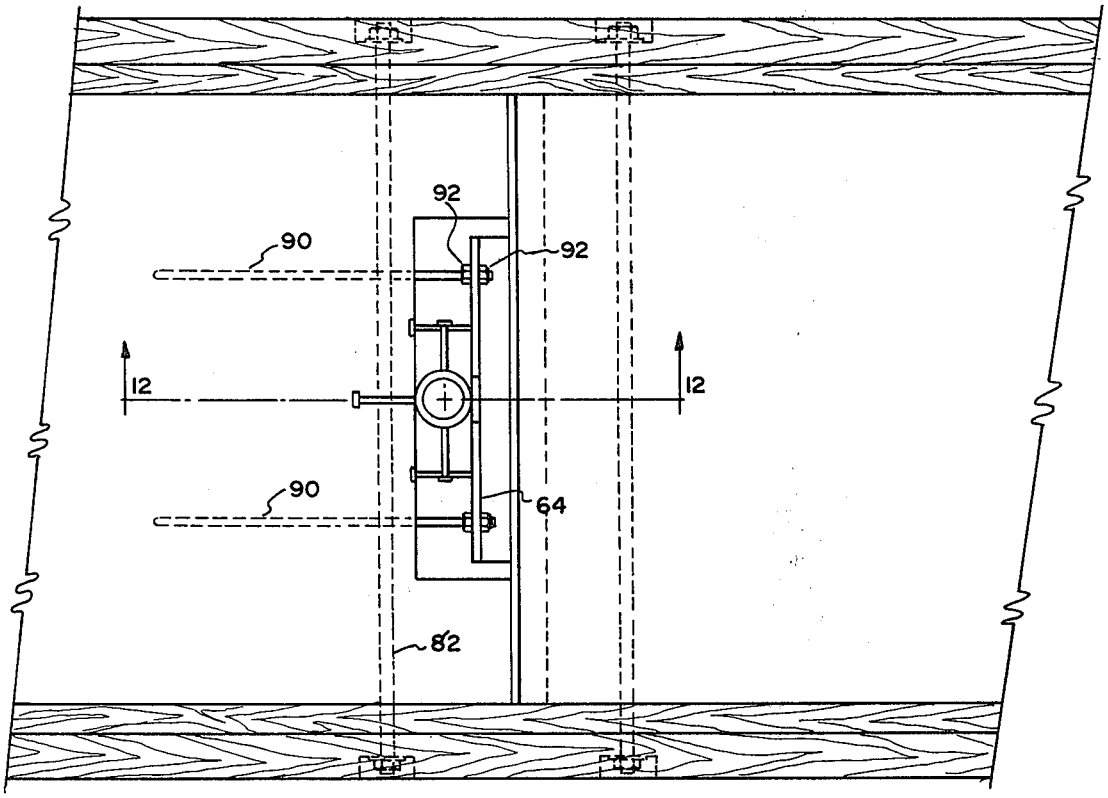
FIG. 11 is a top plan view of the float of FIG. 10 illustrating in greater detail the fastening structure for securing the anchor line to the float.
Figure 12:
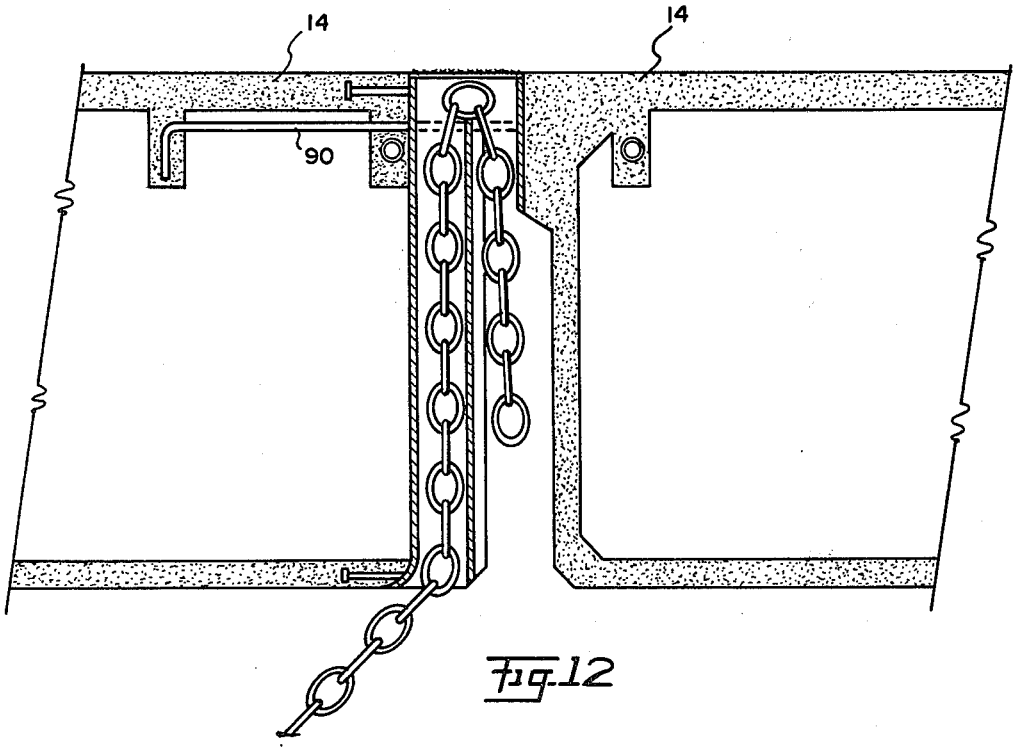
FIG. 12 is a cross-sectional view taken along the line 12—12 of FIG. 11.

A similar structure may be employed where the anchoring line is to be secured to a endwall of a float abutting another float. This structure, illustrated in FIGS. 10–12, is substantially identical to the structure illustrated in FIGS. 7–9. Consequently, identical structures are provided with identical reference numerals. The major difference between the embodiment of FIGS. 7–9 and the embodiment of FIGS. 10–12 is that the reinforcing plate 64 of the latter is recessed within the transverse endwall of the float 12 or 14 and, since the tie rods 82 no longer extend through the plate 64, reinforcing rods 90 are embedded in the concrete forming the float 12 or 14 and are secured to the plate 64 by nuts 92.

The inventive anchoring system for interconnected moorage floats thus accurately fixes the horizontal position of the floats while allowing vertical movement of the floats responsive to tidal action. Furthermore, it can be adapted to a wide variety of conditions including varying depths and irregular sea floors. Additionally, it is more esthetically pleasing than systems heretofor used to prevent horizontal movement of interconnected floats.

I claim:

1. An anchoring system for floating moorages formed by a plurality of aligned mainwalk floats having a plurality of spaced-apart finger floats projecting perpendicularly therefrom, said system comprising:

a generally horizontal grid of post-tensioned cables positioned beneath said floats;

a plurality of anchor lines extending between said floats and said grid, the angle of said lines with respect to the horizontal being relatively small to minimize the downward forces imparted to said floats by said lines, said lines extending in opposite directions beneath said mainwalk floats and said finger floats, with pairs of lines extending beneath said finger floats alternating with pairs of lines extending beneath said mainwalk floats such that horizontal forces exerted on said floats by each line are opposed by substantially equal horizontal forces exerted in an opposite direction by another line, and said lines are shielded by said mainwalk floats and said finger floats; and at least one weight secured to each of said anchor lines to maintain the tension in said lines substantially constant as said floats rise and fall responsive to tidal action.

2. The anchoring system of claim 1 wherein said moorage is located near a bank which slopes into a body of water in which said moorage is floating, said bank having a plurality of vertically disposed, elongated cavities therein, and wherein each of the post-tensioned cables forming said grid adjacent said bank extends through said bank into said cavity and then upwardly to said cavity, where said cable is secured to a stationary fastening member.

3. The anchoring system of claim 1 wherein said grid is suspended below said floats by a plurality of spaced-apart buoys secured to said grid, said system further including a plurality of weights resting on the sea floor and suspended a predetermined distance beneath said grid, said weights having a weight in water which is larger than the buoyant force of said buoys, thereby fixing the vertical position of said grid above said sea floor.

4. The anchoring system of claim 1, further including fastening means for securing said anchor lines to said floats, comprising a vertically disposed tube embedded in said float adjacent one sidewall thereof, said tube having a lower opening near the bottom of said float through which said anchor line is inserted and an upper opening near the top of said float through which said anchor line emerges, said fastening means further including securing means adjacent the upper opening of said tube for securing said line to said float.

5. The anchoring system of claim 4 wherein the end of said anchor line adjacent said float is chain having a plurality of interconnected links, and wherein said securing means includes a slot formed in the upper sidewall of said tube at said upper end, said slot being wider than the thickness of said links and narrower than the width of said links such that insertion of the links in said slot secures said chain to said tube.

6. The anchoring system of claim 4 wherein said tube is secured to a plate extending along the sidewall of said float, said plate being secured to a plurality of reinforcements embedded in said float.

7. An anchoring system for floating moorages formed by a plurality of interconnected floats, comprising:

a generally horizontal grid of post-tensioned cables suspended beneath said floats and above the sea floor by a plurality of spaced-apart buoys secured to said grid;

a plurality of weights resting on said sea floor, said weights being suspended a predetermined distance below said grid and having a weight in water which is greater than the buoyant force of said buoys, thereby fixing the vertical position of said grid above said sea floor;

a plurality of anchor lines extending between said floats and said grid, the angle of said lines with respect to the horizontal being relatively small to minimize the downward forces imparted to said floats by said lines, said lines being symmetrically secured to said floats such that horizontal forces exerted on said floats by each line are opposed by substantially equal horizontal forces exerted in an opposite direction by another line; and at least one weight secured to each of said anchor lines to maintain the tension in said lines substantially constant as said floats rise and fall responsive to tidal action.

8. An anchoring system for floating moorages formed by a plurality of interconnected floats, comprising:

a generally horizontal grid of post-tensioned cables positioned beneath said floats;

a plurality of anchor lines extending between said floats and said grid, the angle of said lines with respect to the horizontal being relatively small to minimize the downward forces imparted to said floats by said lines, said lines being symmetrically secured to said floats such that horizontal forces exerted on said floats by each line are opposed by substantially equal horizontal forces exerted in an opposite direction by another line;

at least one weight secured to each of said anchor lines to maintain the tension in said lines substantially constant as said floats rise and fall responsive to tidal action; and fastening means for securing said anchor lines to said floats, said fastening means including a vertically disposed tube embedded in said float adjacent one sidewall thereof, said tube having a lower opening near the bottom of said float through which said anchor line is inserted and an upper opening near the top of said float through which said anchor line emerges, said fastening means further including securing means adjacent the upper opening of said tube for securing said line to said float.

9. The anchoring system of claim 8 wherein the end of said anchor line adjacent said float is chain having a plurality of interconnected links, and wherein said securing means includes a slot formed in the upper sidewall of said tube at said upper end, said slot being wider than the thickness of said links and narrower than the width of said links such that insertion of the links in said slot secures said chain to said tube.

10. The anchoring system of claim 9 wherein said tube is positioned along a longitudinal sidewall of said float, and wherein an elongated wale extends along the upper longitudinal edges of said floats, said wale having a vertical through-bore formed therein adjacent said tube through which said chain extends downwardly from said slot.

11. The anchoring system of claim 9 wherein said tube is positioned along a transverse endwall of said float, and wherein said tube is embedded in said float adjacent a vertical indentation formed in said transverse endwalls to provide clearance between said float and an adjacent float so that said chain can extend downwardly from said slot between said floats.

12. The anchoring system of claim 8 wherein said tube is secured to a plate extending along the sidewall of said float, said plate being secured to a plurality of reinforcements embedded in said float.

13. The anchoring system of claim 12 wherein said reinforcements are tie rods extending transversely through said floats with their ends being secured to elongated wales extending along the upper longitudinal edges of said floats.

14. An anchoring system for floating moorages formed by a plurality of interconnected mainwalk floats arranged end-to-end in a row and a plurality of finger floats projecting perpendicularly from said mainwalk floats at spaced-apart locations, comprising:

a generally horizontal grid of post-tensioned cables positioned beneath said floats;

a first plurality of anchor lines extending between said floats and said grid, the angle of said lines with respect to the horizontal being relatively small to minimize the downward forces imparted to said floats by said lines, said lines extending in opposite directions parallel to said row of mainwalk floats such that horizontal forces exerted on said floats by each line are opposed by substantially equal horizontal forces exerted in an opposite direction by another line, and said lines are covered by said mainwalk floats to shield said lines from vessels;

a second plurality of anchor lines extending between said floats and said grid, the angle of said lines with respect to the horizontal being relatively small to minimize the downward forces imparted to said floats by said lines, said lines extending in opposite directions perpendicular to said row beneath respective finger floats such that horizontal forces exerted on said floats by each line are opposed by substantially equal horizontal forces exerted in an opposite direction by another line and said lines are covered by said finger floats to shield said lines from vessels; and at least one weight secured to each of said anchor lines to maintain the tension in said lines substantially constant as said floats rise and fall responsive to tidal action.

15. The anchoring system of claim 14 wherein said moorage is located near a bank which slopes into a body of water in which said moorage is floating, said bank having a plurality of vertically disposed, elongated cavities therein, and wherein each of the post-tensioned cables forming said grid adjacent said bank extends through said bank into said cavity and then upwardly to said cavity, where said cable is secured to a stationary fastening member.

16. The anchoring system of claim 14 wherein said grid is suspended below said floats by a plurality of spaced-apart buoys secured to said grid, said system further including a plurality of weights resting on the sea floor and suspended a predetermined distance beneath said grid, said weights having a weight in water which is larger than the buoyant force of said buoys, thereby fixing the vertical position of said grid above said sea floor.

17. The anchoring system of claim 14, further including fastening means for securing said anchor lines to said floats, comprising a vertically disposed tube embedded in said float adjacent one sidewall thereof, said tube having a lower opening near the bottom of said float through which said anchor line is inserted and an upper opening near the top of said float through which said anchor line emerges, said fastening means further including securing means adjacent the upper opening of said tube for securing said line to said float.

* * * * *